US008347518B1

(12) United States Patent
Martinez

(10) Patent No.: US 8,347,518 B1
(45) Date of Patent: Jan. 8, 2013

(54) SCREW MOUNT PLACEMENT DEVICE

(76) Inventor: Richard J. Martinez, Algonquin, IL (US)

( * ) Notice: Subject to any disclaimer, the term of this patent is extended or adjusted under 35 U.S.C. 154(b) by 42 days.

(21) Appl. No.: 13/068,078

(22) Filed: May 2, 2011

Related U.S. Application Data

(60) Provisional application No. 61/330,521, filed on May 3, 2010.

(51) Int. Cl.
*G01D 21/00* (2006.01)

(52) U.S. Cl. ..... 33/613; 33/645

(58) Field of Classification Search ..... 33/613, 33/645, 371, 369
See application file for complete search history.

(56) References Cited

U.S. PATENT DOCUMENTS

| | | | | |
|---|---|---|---|---|
| 3,371,423 | A | 3/1968 | Paul | |
| 4,813,149 | A * | 3/1989 | Herkimer | 33/451 |
| 4,981,400 | A * | 1/1991 | Stover | 33/679 |
| 5,103,573 | A | 4/1992 | Ehling et al. | |
| 5,647,139 | A * | 7/1997 | Richardson | 33/608 |
| 5,927,675 | A | 7/1999 | Kratish et al. | |
| 6,029,362 | A | 2/2000 | Miodragovic | |
| 6,032,378 | A | 3/2000 | Null | |
| 6,047,478 | A * | 4/2000 | Sowers | 33/379 |
| 6,148,529 | A * | 11/2000 | Kennedy | 33/374 |
| 6,286,802 | B1 | 9/2001 | Munson et al. | |
| 6,305,093 | B1 | 10/2001 | Venola | |
| 6,421,928 | B1 * | 7/2002 | Miller | 33/520 |
| 6,430,827 | B2 * | 8/2002 | Ruther | 33/451 |
| 6,907,671 | B2 * | 6/2005 | Conner | 33/485 |
| 7,210,243 | B2 * | 5/2007 | Schmidt et al. | 33/613 |
| 7,509,752 | B2 * | 3/2009 | Schmidt et al. | 33/613 |
| 7,513,056 | B1 * | 4/2009 | Hobden et al. | 33/451 |
| 7,690,129 | B2 | 4/2010 | Bender | |
| 7,814,675 | B2 * | 10/2010 | Venderley et al. | 33/613 |
| 2001/0013176 | A1 * | 8/2001 | Ruther | 33/451 |
| 2002/0078583 | A1 * | 6/2002 | Richardson | 33/613 |
| 2002/0166249 | A1 * | 11/2002 | Liao | 33/451 |
| 2002/0189119 | A1 * | 12/2002 | High | 33/613 |
| 2006/0101661 | A1 * | 5/2006 | Schmidt et al. | 33/613 |
| 2006/0174504 | A1 * | 8/2006 | Szumer et al. | 33/613 |
| 2008/0134535 | A1 * | 6/2008 | Webb | 33/645 |
| 2010/0325905 | A1 | 12/2010 | Coyle | |
| 2010/0325908 | A1 * | 12/2010 | Loisel et al. | 33/613 |

* cited by examiner

*Primary Examiner* — Yaritza Guadalupe-McCall
(74) *Attorney, Agent, or Firm* — Mathew R. P. Perrone, Jr.

(57) ABSTRACT

A screw mount placement device allows an item to be hung levelly and allows the item to be hung in a desired position relative or not relative to already mounted objects on a wall.

12 Claims, 3 Drawing Sheets

SCREW MOUNT PLACEMENT DEVICE

CROSS REFERENCE TO RELATED APPLICATIONS

This application is a continuation in part of, and claims the benefit of priority, to U.S. Provisional Patent Application Ser. No. 61/330,521, filed May 3, 2010, filed by the same inventive entity.

This invention relates a device for the proper hanging and leveling of shelves, pictures, and other items and more particularly to a hanging and leveling device where the item must be positioned in a level manner either for appearances or functionality and aesthetics.

BACKGROUND OF THE INVENTION

Typically, it is a difficult task for an individual to position a picture, shelf, or other hanging decorator or functional item that requires a level placement by themselves using two mounting holes. Holding the item (such as a picture or shelf) or a traditional level; marking the spots to place the desired wall mounting fasteners, and then actually mounting the picture in a desired level position, can waste time and be a painstaking task.

Furthermore, the individual is many times forced to make several attempts to get the desired hanging object at the proper level or height or to achieve the correct spacing of the mounting apertures. In their efforts to do so, they often mark the walls with a marking device, using a trial and error method, thus creating another job to touch up with paint.

In addition to the above, it is often difficult to gain proper visual perspective in hanging new art work with in relation to other existing wall mounted pieces. Often people must lean back to get a better perspective and in doing so might lose their balance and fall. This can be critical if using a taller ladder. An invention that can be used safely on a ladder is a useful invention.

It is very desirable for individuals such as art gallery curators, artists, and even homeowners who work with art, shelves, and mounted wall decor to have such a device that will aid them in quickly, safely, and efficiently mounting the objects in the desired level manner without the need for several tools such as a tape measure, level, pencil and so forth.

SUMMARY OF THE INVENTION

Among the many objectives of the present invention is the provision of a screw mount placement device which can quickly create level marks for hanging and positioning wall mounted items that require two or more mounting screws.

A further objective of the invention is the provision of a screw mount placement device which can be handled efficiently by an individual scaling a ladder.

A still further objective of the present invention is the provision of a screw mount placement device which can align newly mounted items with those already mounted on the wall.

Another objective of the present invention is the provision of a screw mount placement device which aids in securing a level position on or against the wall.

Yet another objective of the present invention is the provision of a screw mount placement device is the screw placement guides which allows for the accurate placement of screws based on the measurements of the item to be mounted.

Another objective to the present invention is the provision of a screw mount placement device which allows the user to calculate how their object is to be mounted.

Yet another objective of the present invention is the provision of a screw mount placement device which aids the user in checking the efficiency of proper vertical alignment.

Moreover, a further objective of the present invention, is the provision of a screw mount placement device which allows the user to readily locate the center between the two mounting apertures.

These and other objectives of the invention (which other objectives become clear by consideration of the specification, claims and drawings as a whole) are met by providing a screw mount placement device which allows an item to be hung levelly and allows the item to be hung in a desired position relative to already mounted objects.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
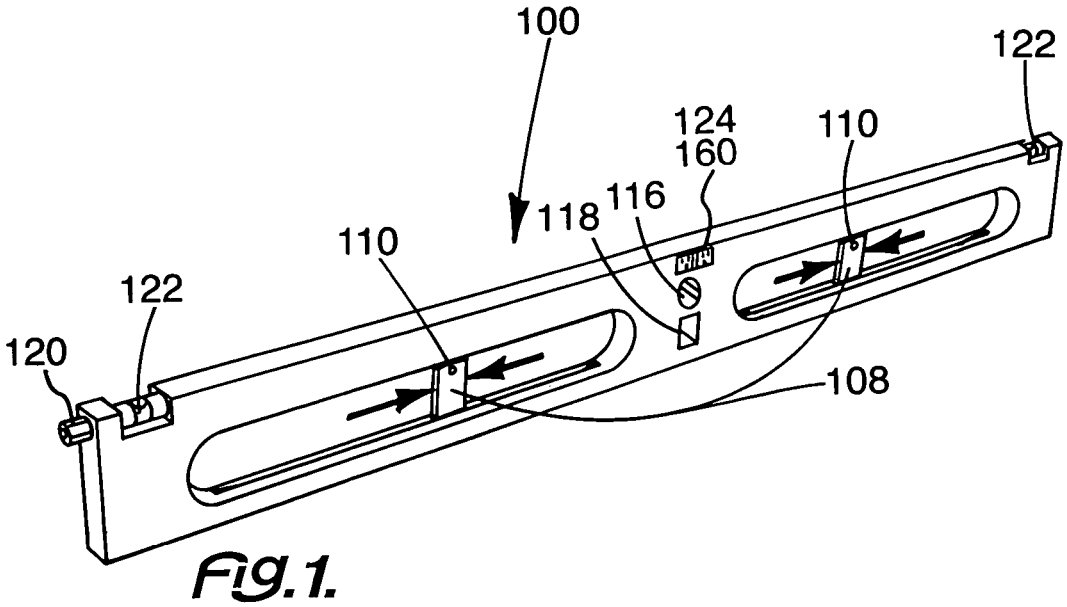
FIG. 1 depicts a front, perspective view of screw mount placement device 100.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

Now referring to FIG. 1, the structure and function of screw mount placement device 100 can be seen. Screw mount placement device 100 has a screw placement measure 124 which cooperates with screw placement guides 108. Screw placement measure 124 measures the distance between screw placement guides 108. Screw mount placement device 100 has a level 122 at opposing ends. Also, an optional, but preferred embodiment, is a laser 120 at opposing ends. Lasers 120 aid in aligning multiple pictures, shelves, or other items to be hung.

Also, screw mount placement device 100 has center aperture 116. Center aperture 116 is always directly in center of each of the screw placement guides 108. This allows the item being mounted to be directly centered over a lower hung object or an existing object on the ground. For example, center aperture 116 can be used to levelly center a mirror over a sink.

Also, screw mount placement device 100 has level aperture 118. Level aperture may hold a level 122 in the vertical position, perpendicular to the ground, to work in conjunction with other levels 122 to properly hang a shelf, picture, or other item to be hung.

Figure 2:
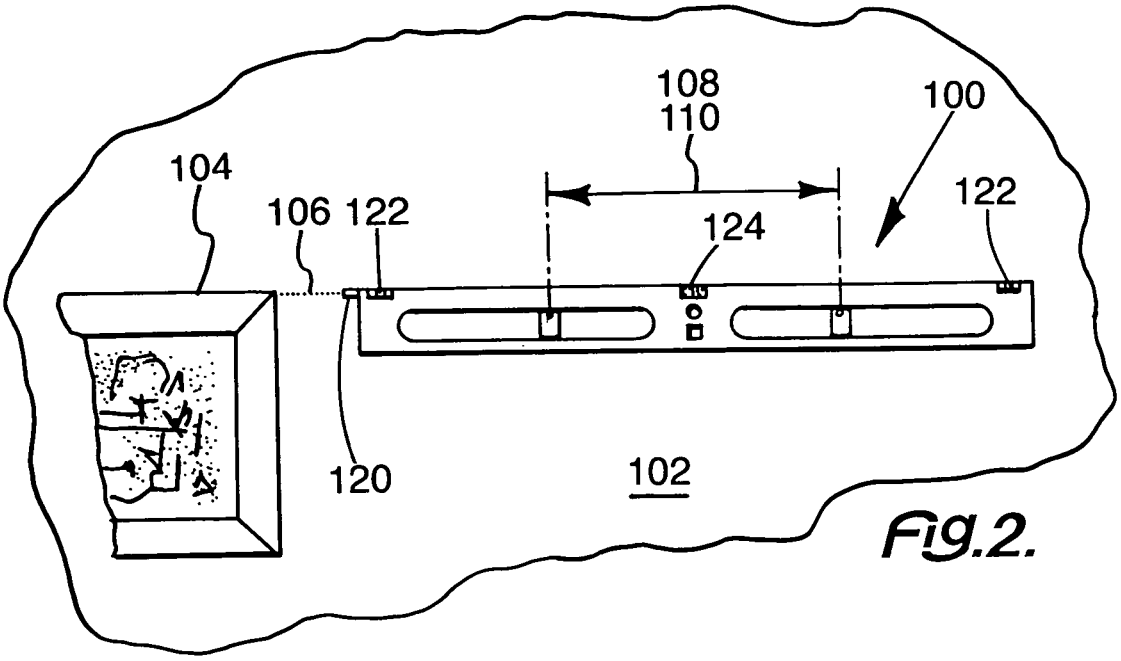
FIG. 2 depicts a front view of screw mount placement device 100 in use.

Now adding FIG. 2 to the consideration, the function of screw mount placement device 100 becomes clear. Mounted piece 104 is hung on wall 102. Screw mount placement device 100 uses beam 106 of lasers 120 to align with mounted piece 104. The screw placement guides 108 are aligned using screw placement measure 124 to ensure a proper distance. The screw placement measure 124 denotes the distance between the screw placement guide apertures 110.

Figure 3:
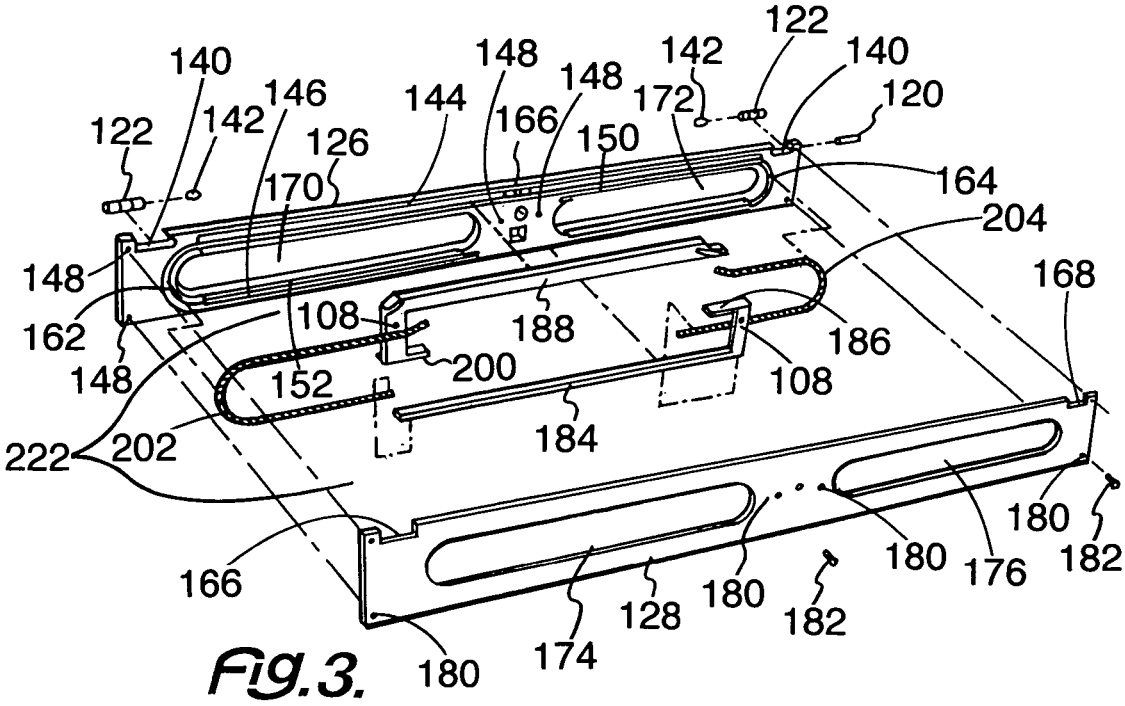
FIG. 3 depicts a rear, perspective, exploded view of screw mount placement device 100.

Now adding FIG. 3 to the consideration, the structure of screw mount placement device 100 can be clearly seen. Main housing 126 and back plate 128 serve as the chassis for the screw mount placement device 100. Main housing 126 and back plate 128 are secured through the cooperation of mounting apertures 180, each of which cooperates with its own threaded blind aperture 148. Each blind aperture 148 receives an assembly screw 182. In other embodiments, the main housing 126 and back plate 128 can be snapped together, held in place by friction, or any other connection that forms a secure and stable relationship between the main housing 126 and back plate 128.

Main housing 126 has measure window 160. Main housing 126 and back plate 128 each have cradles 140 which receives level 122 or laser 120. Level 122 or laser 120 is secured in cradle 140 through silicone 142, other suitable adhesives, friction, apertures in the main housing 126 and back plate 128, or any other secure and suitable mounting means. Laser 120 is secured to the main housing 126 through silicone 142, other suitable adhesives, friction, apertures in the main housing, or any other secure and suitable mounting means. Back plate 128 has right back viewing slot 166 and left back viewing slot 168 which allow levels 122 to be seen.

Housing 126 has right housing window 170 and left housing window 172 while back plate 128 has right back window 174 and left back window 176. Windows 170, 172, 174, and 176 allow accessibility and visibility of screw placement guides 108 and wall 102.

Slide assembly 222 is secured between main housing 126 and back plate 128. Screw placement guides 108 are connected through right travelling line 202 and left travelling line 204. Right screw placement guide 108 has large top slide 188 which moves in and through small bottom slide 200 for strength and stability. Left screw placement guide 108 has first small top slide 186 and large bottom slide 184. Left travelling line 204 and right travelling line 202 guide the movement of the screw placement guides 108.

The right travelling line 202 is fixed and mounted in the large top slide 188 with the bottom portion attached to the large bottom slide 184. By the same means, the left travelling line 204 is attached to large top slide 188, and the large bottom slide 184. The first small top slide 186 and second small bottom slide 200 shown in FIG. 3 also add to the smooth sliding function as the slides glide back and forth. Each of the two guides 108 has a vertical section with a screw placement guide aperture 110.

Housing 126 has right flexible guide 162 and left flexible guide 164 (sometimes referred to as right cable guide and left cable guide) which receive flexible lines 202 and 204 respectively. Flexible guides 162 and 164 are arced to allow flexible lines 202 and 204 to move freely and allow synchrony between screw placement guides 108.

In this embodiment, travelling lines 202 and 204 are referenced. However, this terminology is not meant to limit the scope of this disclosure. Flexible lines 202 and 204 may be replaced by thin metal, plastics, or any other suitable mechanism which is also covered by this disclosure.

In this embodiment flexible lines 202 and 204 are depicted as separated and connected through large bottom slide 184, first small top slide 186, large top slide 188 and small bottom slide 200. However flexible lines 202 and 204 may be a continuous piece. Also, flexible lines 202 and 204 may be attached in different configurations and to different areas of large bottom slide 184, first small tip slide 186, large top slide 188, and small bottom slide 200. For example, travelling lines 202 and 204 may be a continuous line. The top of the continuous travelling line can attach to large top slide 188 and also to screw placement guides 108. This attachment allows each screw placement guides 108 to move through the movement of continuous travelling line. If the continuous travelling line was not connected to the large top slide 188 or the screw placement guide 108, there is not synchrony of movement. The synchrony of movement is what allows screw placement guides 108 and screw placement measure 124 to accurately depict the distance between and the distance from center aperture 116.

Housing 126 has to receive large top slide 188 and small bottom slide 200. Also, housing 126 has left upper slide guide 150 and lower slide guide 152 to receive first small top slide 186 and large bottom slide 184. Slide guides 144, 146, 150, and 152 guide the movement of screw placement guides 108.

Figure 4:
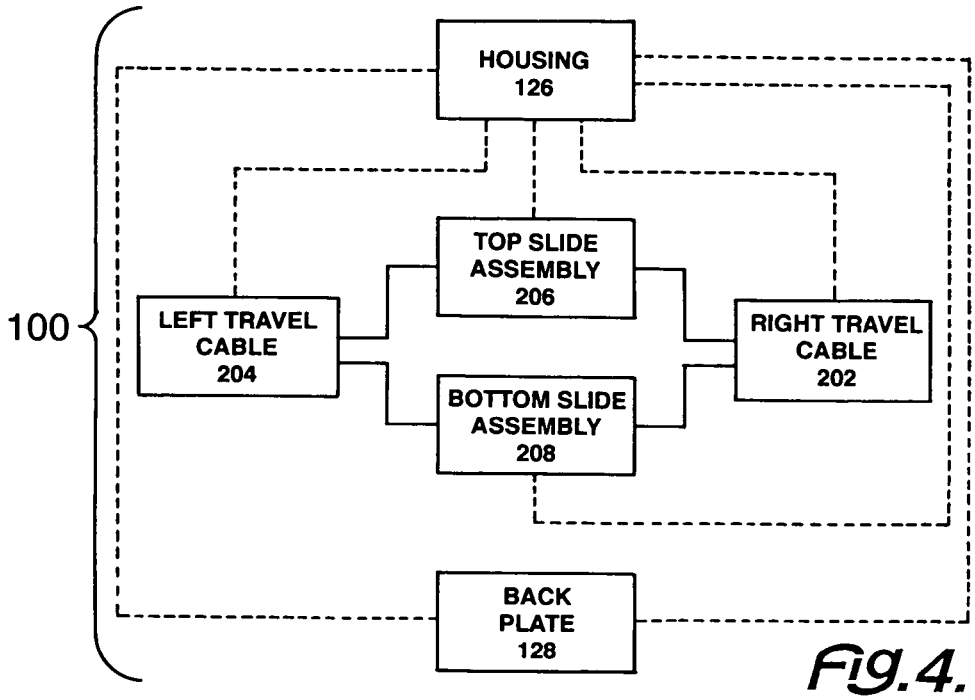
FIG. 4 depicts a box diagram of screw mount placement device 100.

Now adding FIG. 4 to the consideration, the structure of screw mounting placement device 100 is seen. Screw mounting placement device 100 has housing 126 and back plate 128. Secured between housing 126 and back plate 128 is top slide assembly 206 and bottom slide assembly 208. Top slide assembly 206 and bottom slide assembly 208 are each attached to left travelling line 204 and right travelling line 202 which can also be referred to as left travel cable 204 and right travel cable 202.

Figure 5:
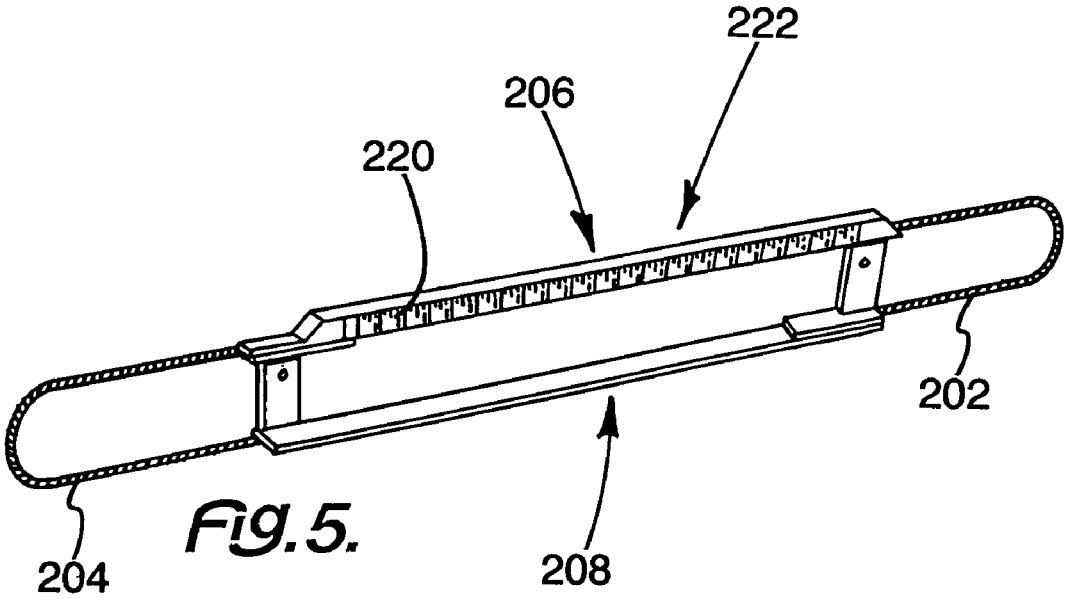
FIG. 5 depicts a front, perspective view of slide assembly 222 of screw mount placement device 100.
Figure 6:
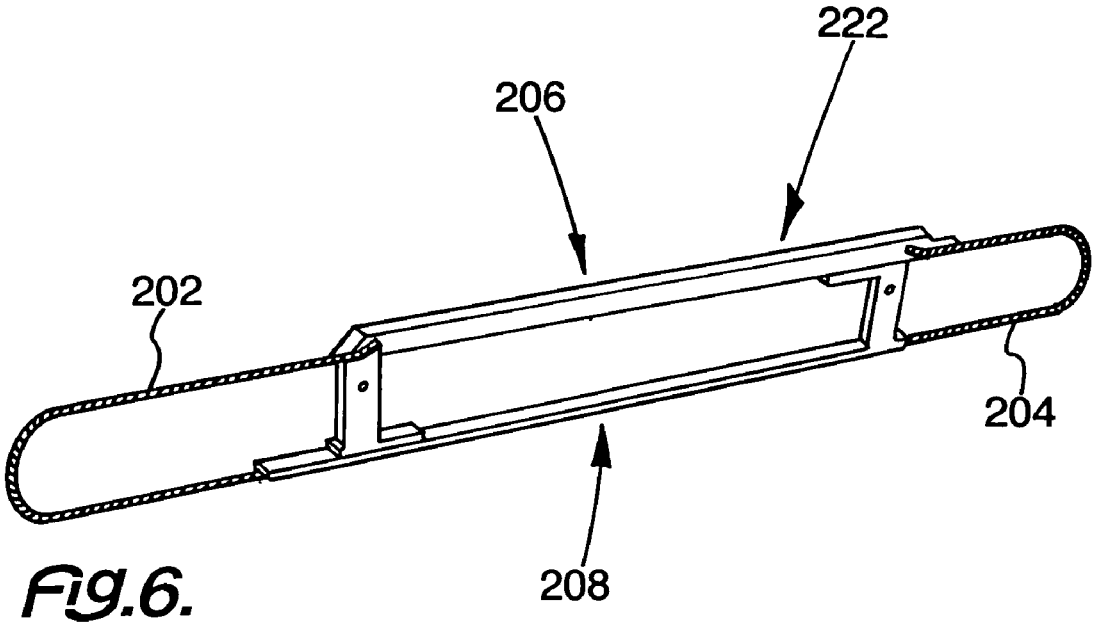
FIG. 6 depicts a rear, perspective view of slide assembly 222 of screw mount placement device.

Now adding FIG. 5 and FIG. 6 to the consideration, the structure of main slide assembly 222 can be clearly seen. Main slide assembly 222 includes top slide assembly 206 and bottom slide assembly 208. Top slide assembly 206 and bottom slide assembly 208 are connected through right travelling line 202 and left travelling line 204. Slide assembly 222 guides the movement of screw placement guides 108. Graduated measures 220 accurately depict the distance between the screw placement guides 108 and ultimately the screws. Graduated measures 220 are also centered to center aperture 116. Graduated measures can be inches, feet, centimeters, meters, or any other suitable measurement gradients.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A screw mount placement device for mounting an item in a desired position comprising:

a) a housing being provided for the screw mount placement device;

b) a screw placement measure cooperating with at least a first screw placement guide and a second screw placement guide to form the screw mount placement device;

c) the screw placement measure measuring the distance between the first screw placement guide and the second screw placement guide;

d) the screw placement measure, the first screw placement guide and the second screw placement guide being supported in the housing;

e) a first level or a first laser being positioned at a first end of the housing;

f) a second level or a second laser being positioned at a second end of the housing;

g) the first end of the housing being oppositely disposed from the second end of the housing;

h) the housing combining with a back plate for the screw mount placement device;

i) the housing having a measure window;

j) the housing and the back plate having cradles to receive first level or first laser and second level and second laser;

k) the back plate having a first viewing slot and a second viewing slot in order to permit first level and second level to be seen;

l) the housing having a right housing window and a left housing window;

m) the back plate having a right back window and a left back window;

n) a first screw placement guide and a second screw placement guide permitting the screw mount placing device to operate;

o) the right housing window cooperating with the right back window to allow accessibility and visibility of the first screw placement guide;

p) the left housing window cooperating with the left back window to allow accessibility and visibility of the second screw placement guide;

q) the movement of each of the screw placement guides being dependent upon each other;

r) a slide assembly being secured between the housing and the back plate;

s) the first screw placement guide being connected through a right travelling line;

t) the second screw placement guide being connected through a left travelling line;

u) the right screw placement guide including a large top slide and a small bottom slide for strength and stability;

v) the large top slide movable receiving small bottom slide for strength and stability;

w) the left screw placement guide including a small top slide and a large bottom slide for strength and stability;

x) the small top slide moving in and through large bottom slide for strength and stability.

2. The screw mount placing device of claim 1 further comprising:

a) the left flexible guide and the right flexible guide guiding movement of the first screw placement guide and the second screw placement guide;

b) at least two screws securing the housing to the back plate or the housing being secured to the back plate through a snap fit; and c) the first level or the first laser and the second level or the second laser being secured in the cradles adhesively or frictionally.

3. The screw mount placing device of claim 2 further comprising:

a) a right flexible guide cooperating with the large top slide at a top travelling line portion;

b) the right flexible guide cooperating with the large bottom slide at a bottom travelling line portion;

c) a left flexible guide cooperating with the large top slide;

d) the left flexible guide cooperating with the large bottom slide;

e) the first small top slide and a second small top slide adding to a smooth sliding function for the screw mount placing device; and f) the first guide and the second guide each having a vertical section with a screw placement guide aperture.

4. The screw mount placing device of claim 3 further comprising:

a) the housing having a right flexible guide and a left flexible guide b) the right flexible guide and the left flexible guide receiving a first travelling line and a second travelling line;

c) the right flexible guide and the left flexible guide including an arced section in order to allow the first travelling line and the second travelling line to move freely and allow synchrony between the first screw placement guide and the second screw placement guide;

d) the housing having a center aperture; and e) the center aperture allowing the screw placement guides to be centered around the center aperture.

5. The screw mount placing device of claim 4 further comprising:

a) the housing having a right upper slide guide and a lower slide guide to receive the small top slide and the large bottom slide;

b) the left upper slide guide and the lower slide guide guiding movement of the first screw placement guide and the second screw placement guide;

c) the top slide assembly and the bottom slide assembly being secured between the housing and the back plate;

d) the top slide assembly and the bottom slide assembly being each attached to the left travelling line and the right travelling line; and e) the top slide assembly and the bottom slide assembly forming a main slide assembly.

6. The screw mount placing device of claim 5 further comprising:

a) the top slide assembly and the bottom slide assembly being connected through the right travelling line and the left travelling line or the slide assembly and the travelling line being a continuous piece;

b) the slide assembly guiding the movement of the first screw placement guide and the second screw placement guide; and c) a graduated measure depicting a distance between the first screw placement guide and the second screw placement guide.

7. A method of mounting a piece on wall comprising:

a) aligning a screw mount placement device with the piece;

b) using a first laser or a first level and a second laser or a second level on the screw mount placement device to align with the piece;

c) using a first screw placement guide and a second screw placement guide on the screw mount placement device to provide a mounting support for the piece;

d) securing the mounting source to a desired surface;

e) applying the piece to mounting source;

f) aligning the first screw placement guide and the second screw placement guide with a screw placement measure on the screw mount placement device;

g) supporting the screw mount placement device with a housing;

h) providing a screw placement measure cooperating with at least a first screw placement guide and a second screw placement guide to form the screw mount placement device;

i) using the screw placement measure to determine the distance between the first screw placement guide and the second screw placement guide;

j) supporting the screw placement measure, the first screw placement guide and the second screw placement guide in the housing;

k) a first level or a first laser being positioned at a first end of the housing;

l) a second level or a second laser being positioned at a second end of the housing;

m) the first end of the housing being oppositely disposed from the second end of the housing;

n) the housing combining with a back plate for the screw mount placement device;

o) the housing having a measure window;

p) the housing and the back plate having cradles to receive first level or first laser and second level and second laser;

q) the back plate having a first viewing slot and a second viewing slot in order to permit first level and second level to be seen;

r) the housing having a right housing window and a left housing window;

s) the back plate having a right back window and a left back window;

t) a first screw placement guide and a second screw placement guide permitting the screw mount placing device to operate;

u) the right housing window cooperating with the right back window to allow accessibility and visibility of the first screw placement guide;

v) the left housing window cooperating with the left back window to allow accessibility and visibility of the second screw placement guide; and w) the movement of each of the screw placement guides being dependent upon each other;

x) a slide assembly being secured between the housing and the back plate;

y) the first screw placement guide being connected through a right travelling line;

z) the second screw placement guide being connected through a left travelling line;

aa) the right screw placement guide including a large top slide and a small bottom slide for strength and stability;

bb) the large top slide movable receiving small bottom slide for strength and stability;

cc) the left screw placement guide including a small top slide and a large bottom slide for strength and stability; and dd) the small top slide moving in and through large bottom slide for strength and stability.

8. The method of claim 7 further comprising:

a) the left travelling line and the right travelling line guiding movement of the first screw placement guide and the second screw placement guide or the slide assembly and the travelling line being a continuous piece;

b) at least two screws securing the housing to the back plate or through a snap fit;

c) the first level or the first laser and the second level or the second laser being secured in the cradles adhesively or frictionally;

d) a right travelling line cooperating with the large top slide at a top travelling line portion;

e) the right travelling line cooperating with the large bottom slide at a bottom travelling line portion;

f) a left travelling line cooperating with the large top slide;

g) the left travelling line cooperating with the large bottom slide;

h) the first small top slide and a second small top slide adding to a smooth sliding function for the screw mount placing device; and i) the first guide and the second guide each having a vertical section with a screw placement guide aperture.

9. The method of claim 8 further comprising:

a) the housing having a right flexible guide and a left flexible guide b) the right flexible guide and the left flexible guide receiving a first travelling line and a second travelling line;

c) the right flexible guide and the left flexible guide including an arced section in order to allow the first travelling line and the second travelling line to move freely and allow synchrony between the first screw placement guide and the second screw placement guide;

d) the housing having a right upper slide guide and a lower slide guide to receive the small top slide and the large bottom slide;

e) the left upper slide guide and the lower slide guide guiding movement of the first screw placement guide and the second screw placement guide;

f) the top slide assembly and the bottom slide assembly being secured between the housing and the back plate;

g) the top slide assembly and the bottom slide assembly being each attached to the left travelling line and the right travelling line;

h) the top slide assembly and the bottom slide assembly forming a main slide assembly;

i) the top slide assembly and the bottom slide assembly being connected through the right travelling line and the left travelling line;

j) the slide assembly guiding the movement of the first screw placement guide and the second screw placement guide;

k) a graduated measure depicting a distance between the first screw placement guide and the second screw placement guide; and l) the housing having a center aperture; and m) the center aperture allowing the screw placement guides to be centered around the center aperture.

10. A screw mount placement device for mounting an item in a desired position comprising:

a) a housing and a back plate being provided for the screw mount placement device;

b) the housing and the back plate being secured through the cooperation of mounting apertures with threaded blind apertures which receive assembly screws or through a snap fit;

c) a screw placement measure cooperating with at least a first screw placement guide and a second screw placement guide to form the screw mount placement device;

d) the screw placement measure measuring the distance between the first screw placement guide and the second screw placement guide;

e) the screw placement measure, the first screw placement guide and the second screw placement guide being supported in the housing;

f) a first level or a first laser being positioned at a first end of the housing;

g) a second level or a second laser being positioned at a second end of the housing;

h) the first end of the housing being oppositely disposed from the second end of the housing;

i) the housing combining with a back plate for the screw mount placement device;

j) the housing having a measure window;

k) the housing and the back plate having cradles to receive first level or first laser and second level and second laser; and l) the back plate having a first viewing slot and a second viewing slot in order to permit first level and second level to be seen.

11. The screw mount placing device of claim 10 further comprising:

a) the housing having a right housing window and a left housing window;

b) the back plate having a right back window and a left back window;

c) a first screw placement guide and a second screw placement guide permitting the screw mount placing device to operate;

d) the right housing window cooperating with the right back window to allow accessibility and visibility of the first screw placement guide;

e) the left housing window cooperating with the left back window to allow accessibility and visibility of the second screw placement guide;

f) a slide assembly being secured between the housing and the back plate;

g) the first screw placement guide being connected through a right travelling line;

h) the second screw placement guide being connected through a left travelling line;

i) the right screw placement guide including a large top slide and a small bottom slide for strength and stability;

j) the large top slide movable receiving small bottom slide for strength and stability;

k) the left screw placement guide including a small top slide and a large bottom slide for strength and stability;

l) the small top slide moving in and through large bottom slide for strength and stability;

m) the movement of each of the screw placement guides being dependent upon each other;

n) the housing having a center aperture; and o) the center aperture allowing the screw placement guides to be centered around the center aperture.

12. The screw mount placing device of claim 11 further comprising:

a) the left travelling line and the right travelling line guiding movement of the first screw placement guide and the second screw placement guide or the slide assembly and the travelling line being a continuous piece;

b) the first level or the first laser and the second level or the second laser being secured in the cradles adhesively or frictionally;

c) a right travelling line cooperating with the large top slide at a top travelling line portion;

d) the right travelling line cooperating with the large bottom slide at a bottom travelling line portion;

e) a left travelling line cooperating with the large top slide;

f) the left travelling line cooperating with the large bottom slide;

g) the first small top slide and a second small top slide adding to a smooth sliding function for the screw mount placing device;

h) the first guide and the second guide each having a vertical section with a screw placement guide aperture;

i) the housing having a right flexible guide and a left flexible guide;

j) the right flexible guide and the left flexible guide receiving a first travelling line and a second travelling line;

k) the right flexible guide and the left flexible guide including an arced section in order to allow the first travelling line and the second travelling line to move freely and allow synchrony between the first screw placement guide and the second screw placement guide;

l) the housing having a right upper slide guide and a lower slide guide to receive the small top slide and the large bottom slide;

m) the left upper slide guide and the lower slide guide guiding movement of the first screw placement guide and the second screw placement guide;

n) the top slide assembly and the bottom slide assembly being secured between the housing and the back plate;

o) the top slide assembly and the bottom slide assembly being each attached to the left travelling line and the right travelling line;

p) the top slide assembly and the bottom slide assembly forming a main slide assembly;

q) the top slide assembly and the bottom slide assembly being connected through the right travelling line and the left travelling line;

r) the slide assembly guiding the movement of the first screw placement guide and the second screw placement guide;

s) a graduated measure depicting a distance between the first screw placement guide and the second screw placement guide; and t) a center aperture depicting a distance exactly halfway between the first screw placement guide and the second screw placement guide.

* * * * *